United States Patent [19]

Olewinski et al.

[11] 4,222,140

[45] Sep. 16, 1980

[54] BOARDING PLATFORM

[75] Inventors: William J. Olewinski; Teddy G. Smith; John L. Papizan, all of Baton Rouge, La.

[73] Assignee: F. C. Schaffer & Associates, Inc., Baton Rouge, La.

[21] Appl. No.: 14,562

[22] Filed: Feb. 23, 1979

[51] Int. Cl.[2] ..... E01D 1/00

[52] U.S. Cl. ..... 14/71.3; 187/94; 187/73; 14/71.5; 182/36

[58] Field of Search ..... 14/69.5, 71.1, 71.3, 14/42; 187/73, 80, 75, 76, 94, 95, 2, 6, 1 R; 405/200; 182/36, 38, 101, 37

[56] References Cited

U.S. PATENT DOCUMENTS

| | | | |
|---|---|---|---|
| 610,901 | 9/1898 | Herren | 187/94 X |
| 980,522 | 1/1911 | Haywood | 14/71.1 |
| 1,068,105 | 7/1913 | Carman | 187/95 X |
| 1,111,872 | 9/1914 | Strauss | 14/42 |
| 1,698,209 | 1/1929 | Barlow | 187/94 X |
| 1,797,808 | 3/1931 | Tomkinson | 14/71.1 |
| 1,936,780 | 11/1933 | Arnold | 187/95 X |
| 2,029,419 | 2/1936 | Gilowitz | 187/94 X |
| 2,677,141 | 5/1954 | Senn | 14/71.1 |
| 2,963,178 | 12/1960 | Walker | 14/71.1 X |
| 3,913,757 | 10/1975 | Lovey | 14/71.5 X |

*Primary Examiner*—Nile C. Byers, Jr.

*Attorney, Agent, or Firm*—Pearne, Gordon, Sessions

[57] ABSTRACT

A boarding platform for transferring personnel between a fixed dock structure and a barge or the like is disclosed. The boarding platform includes a pair of vertical tracks having a carriage mounted for raising and lowering movements relative to the tracks. A boarding ramp is mounted on the carriage which is normally biased to a vertical or raised position. Counterweights are provided on the carriage so that a main raising cable carries only a portion of the weight of the carriage and the ramp. A winding motor for the main cable is suspended from a high-low weight sensing load cell which operates a mechanism to lock the carriage relative to the tracks (a) if a person stands on the ramp, (b) if the main cable breaks, or (c) if one or more of the counterweights releases.

17 Claims, 9 Drawing Figures

Fig. 1
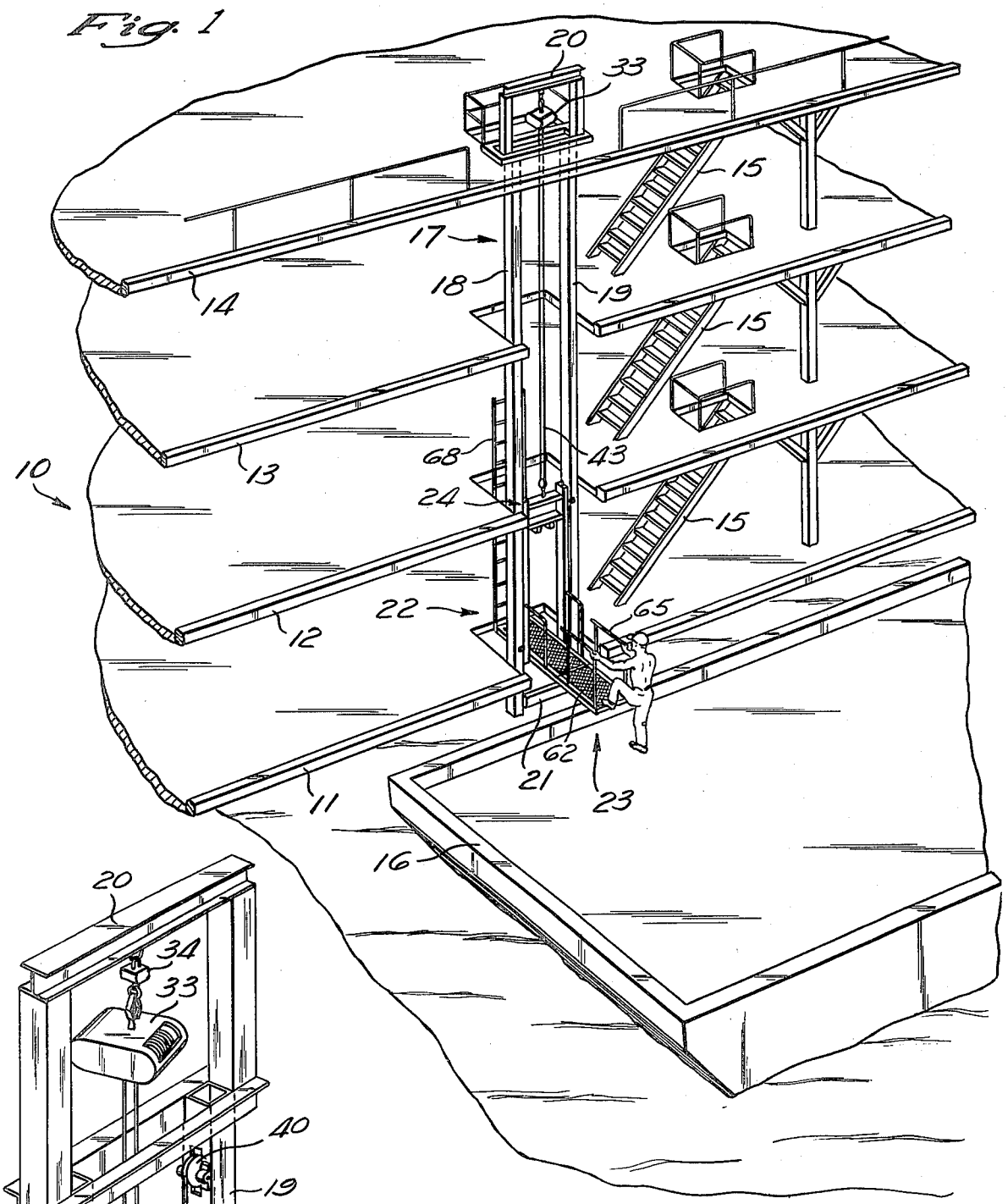
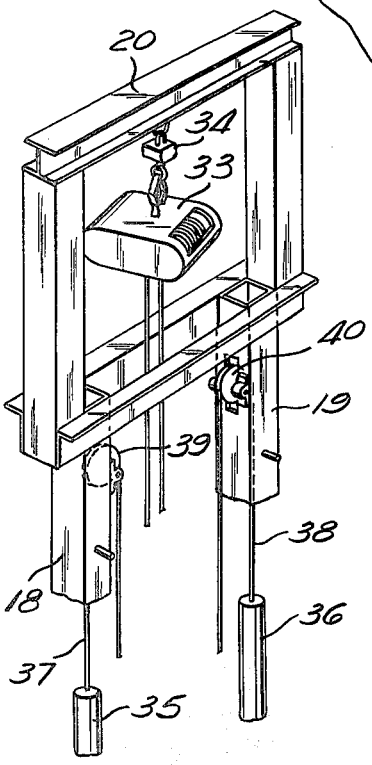
Fig. 4

Fig. 6
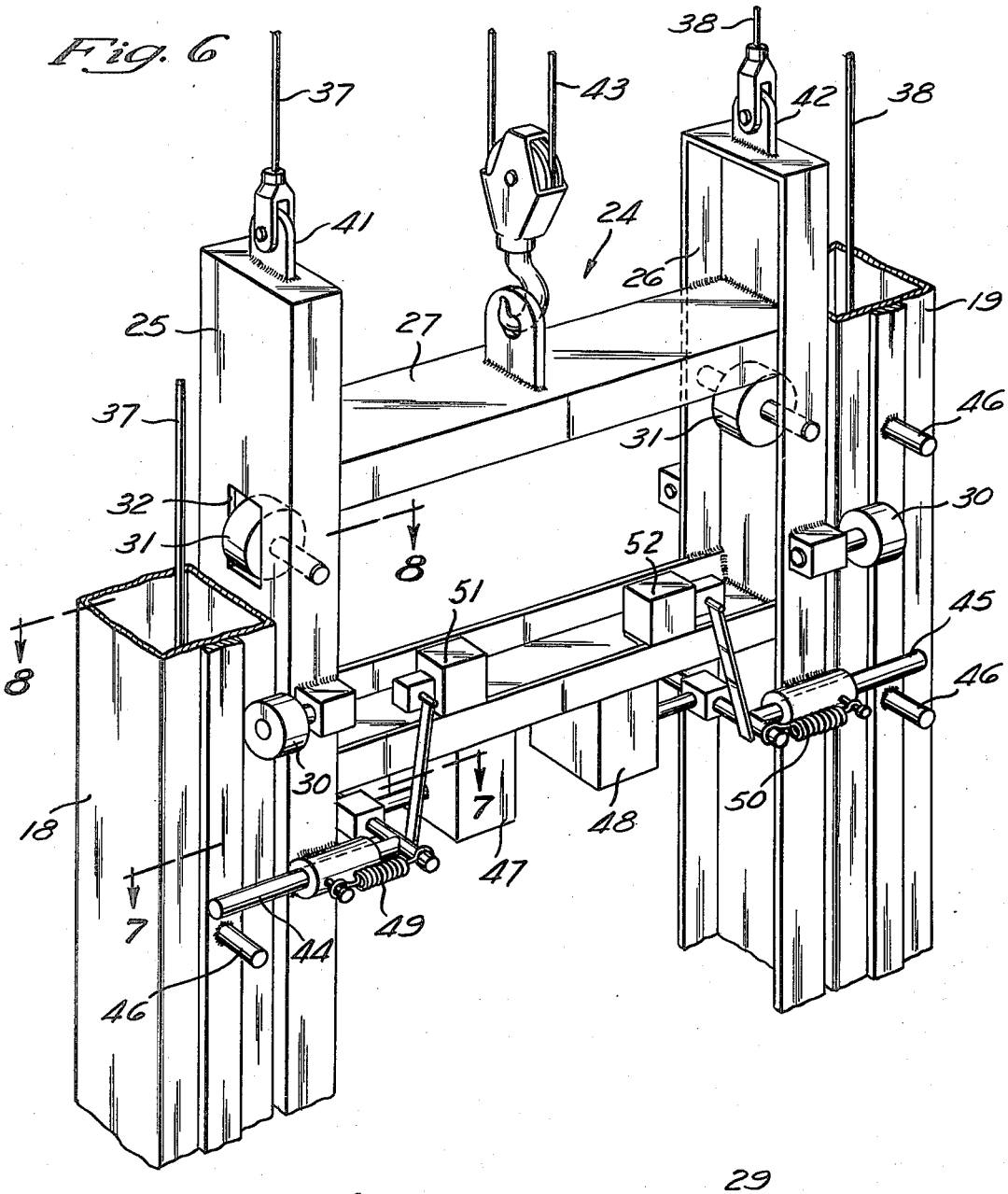
Fig. 7
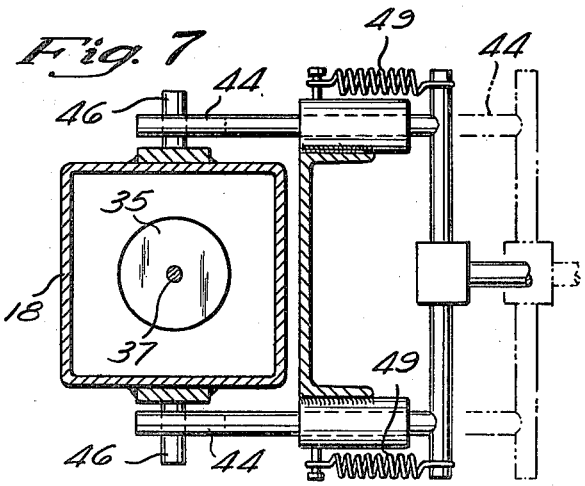
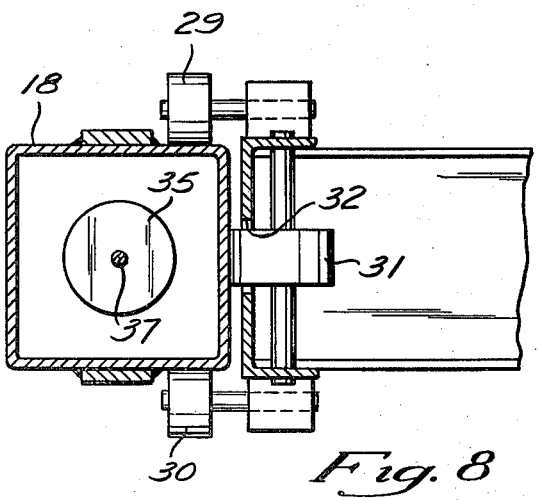
Fig. 8

BOARDING PLATFORM

BACKGROUND OF THE INVENTION

This invention relates to boarding platforms for transferring personnel between a fixed dock structure and a barge or the like. More particularly, this invention relates to a boarding platform which is capable of adjusting its vertical position to accommodate varying tidal conditions. Marine boarding platforms range from simple boarding platforms fixed to the dock structure to fairly elaborate arrangements fixed to both the vessel and the dock structure with complex mechanisms to permit the platform to accommodate for swells and for parallel and perpendicular drifting relative to the dock. Due to the unpredictable nature of bodies of water, and particularly the peculiarities of river and coastal waters, such prior art devices have not been entirely successful principally because of their lack of safety features and their lack of versatility. For example, a simple gangplank in use today presents the possibility of injury or equipment damage if a river swell causes the barge to rise contacting the gangplank. A further hazardous condition exists if the barge drifts parallel to or perpendicular to the dock and there may be possible damage or serious injury should a person fall between the vessel and the dock.

SUMMARY OF THE INVENTION

This invention provides a boarding platform with improved safety and operational features which is simple to construct and install. More specifically, this invention relates to a boarding platform for transferring personnel between a fixed dock structure and a barge or the like which has a vertical track structure comprising a pair of parallel columns. The dock structure has a number of levels open to the waterfront, and the vertical track means is attached to the dock structure at the open portion thereof. The vertical track arrangement carries a boarding platform means having a ramp portion and carriage portion which are mounted for raising and lowering movement along the track means to attain a number of different boarding levels, depending upon the tidal conditions of the body of water. With a barge tied to the dock, the carriage portion of the boarding platform means is raised or lowered to a position wherein the ramp portion is approximately two feet above the barge to ensure that swells will not cause the barge to strike the ramp. The ramp, however, is normally retained in a vertically retracted position, since it is hinged to the carriage and is provided with counterweights which tend to hold the ramp upwardly. The weight of a person will overcome the counterweights to bring the ramp to a horizontal position over the barge. When the person leaves the ramp and steps onto the barge, the ramp is raised by its counterweights. To transfer personnel from the barge to the loading dock, the ramp provided with a line at its distal end so that a crew member may pull the ramp downwardly by the line.

A vertical ladder is associated with the boarding platform means and has a length greater than the vertical distance between adjacent dock levels so that a person on the ramp may climb the ladder to reach the closest level.

The carriage, and therefore the ramp, may be raised or lowered to a desired level by a cable which extends from the carriage to a winding motor located adjacent the top of the vertical tracks. The carriage is guided along the tracks by rollers and counterweights are provided to remove most of the load from the motor.

There is provided a safety mechanism to ensure that the carriage cannot be moved when a person is on the ramp or if the main cable or the counterweight cables break. To this end, there is provided a load cell between the stationary frame which mounts the carriage and the winding motor. The load cell is a high-low load sensor so that if the load cell senses a weight substantially greater than the sensed weight of the ramp, carriage, and winding motor, the motor will be shut off and immediately braked. Solenoids are responsive to the load cell to permit spring-biased locking dogs to engage a pair of a series of pins on the vertical track members. These pins are spaced about one foot apart so that the furthest the carriage may drop would be one foot. Also, if one or more of the counterweight-carrying cables broke, a higher load would be sensed and the locking dogs would similarly be actuated. Since the load cell is a low weight sensing device, the locking dogs would also be operated if the main raising and lowering cable of failed.

BRIEF DESCRIPTION OF THE DRAWING

FIG. 1 is a perspective view of a boarding dock and an associated platform in accordance with this invention illustrating a person transferring himself between the loading dock and a barge;

FIG. 4 is a fragmentary, perspective view of the top of the apparatus, illustrating the winding motor and the counterweights for the carriage;

FIG. 6 is a detailed, perspective view of the locking dogs according to this invention;

FIG. 7 is a cross sectional view, the plane of the view being indicated by the line 7—7 in FIG. 6;

FIG. 8 is a cross sectional view, the plane of the section being indicated by the line 8—8 in FIG. 6.

DETAILED DESCRIPTION OF THE INVENTION

Figure 2:
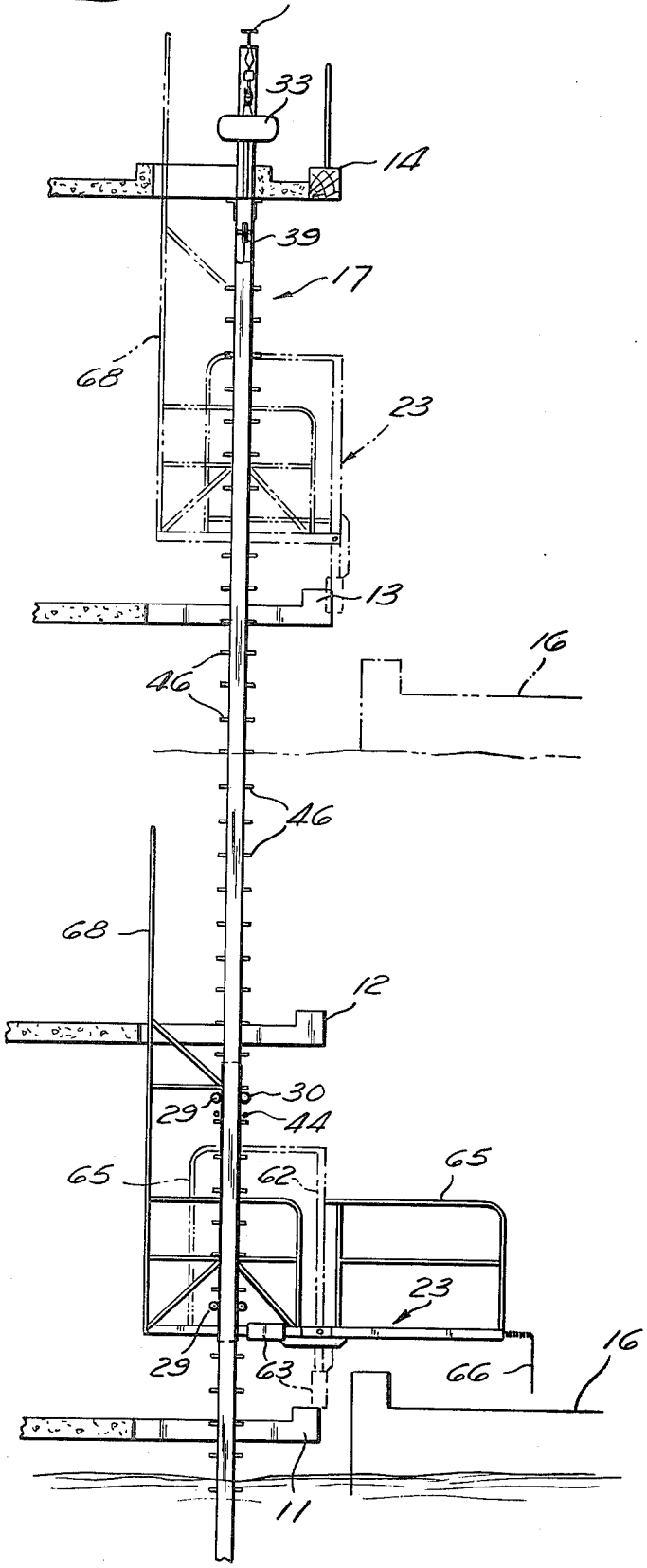
FIG. 2 is a semischematic, elevational view of a boarding platform in accordance with this invention.
Figure 3:
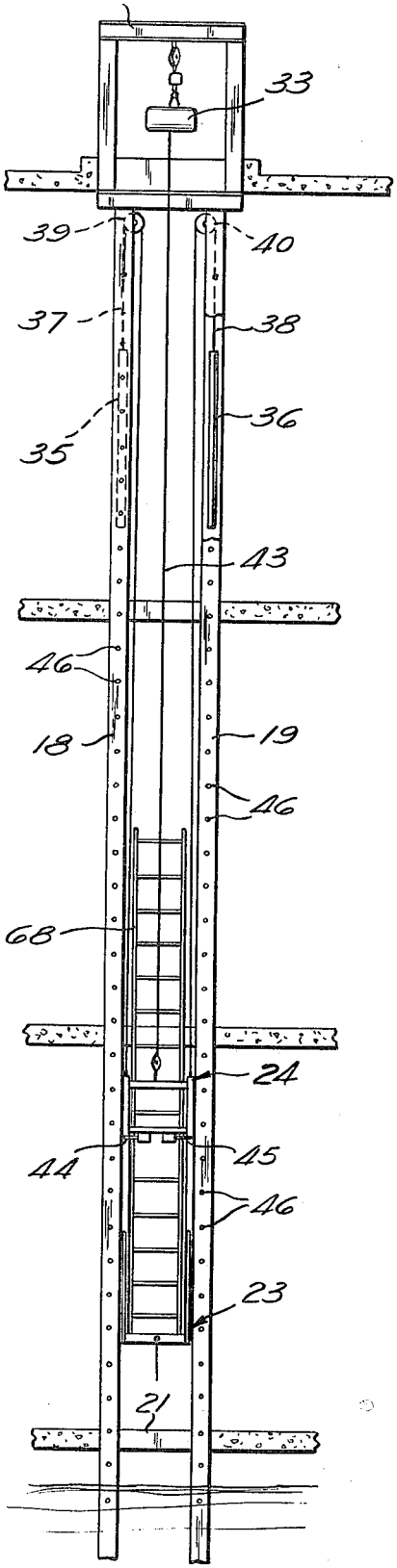
FIG. 3 is a front elevational view of the boarding platform assembly shown in FIG. 2.

Referring now to the drawings, and initially to FIG. 1, a dock structure 10 is provided which has a number of boarding levels 11, 12, 13, and 14. Such dock structures are common in those regions of greatly varying tidal conditions. Thus, in many areas of the world, tides run as much as 30 feet or more and the dock structure must accommodate for such fluctuations. Therefore, multilevel docks are provided so that access may be had to a conveniently adjacent level regardless of the level of the tides. A person attaining such a level would then use stairways 15 to reach the top level 14.

In order to aid personnel in transferring between, for example, a barge 16 and one of the levels 11–14, there is provided a boarding platform assembly 17. A vertical track assembly comprises a pair of parallel, vertical beams or columns 18 and 19 which are tied together at their ends by a top beam 20 and a bottom beam 21.

Figure 9:
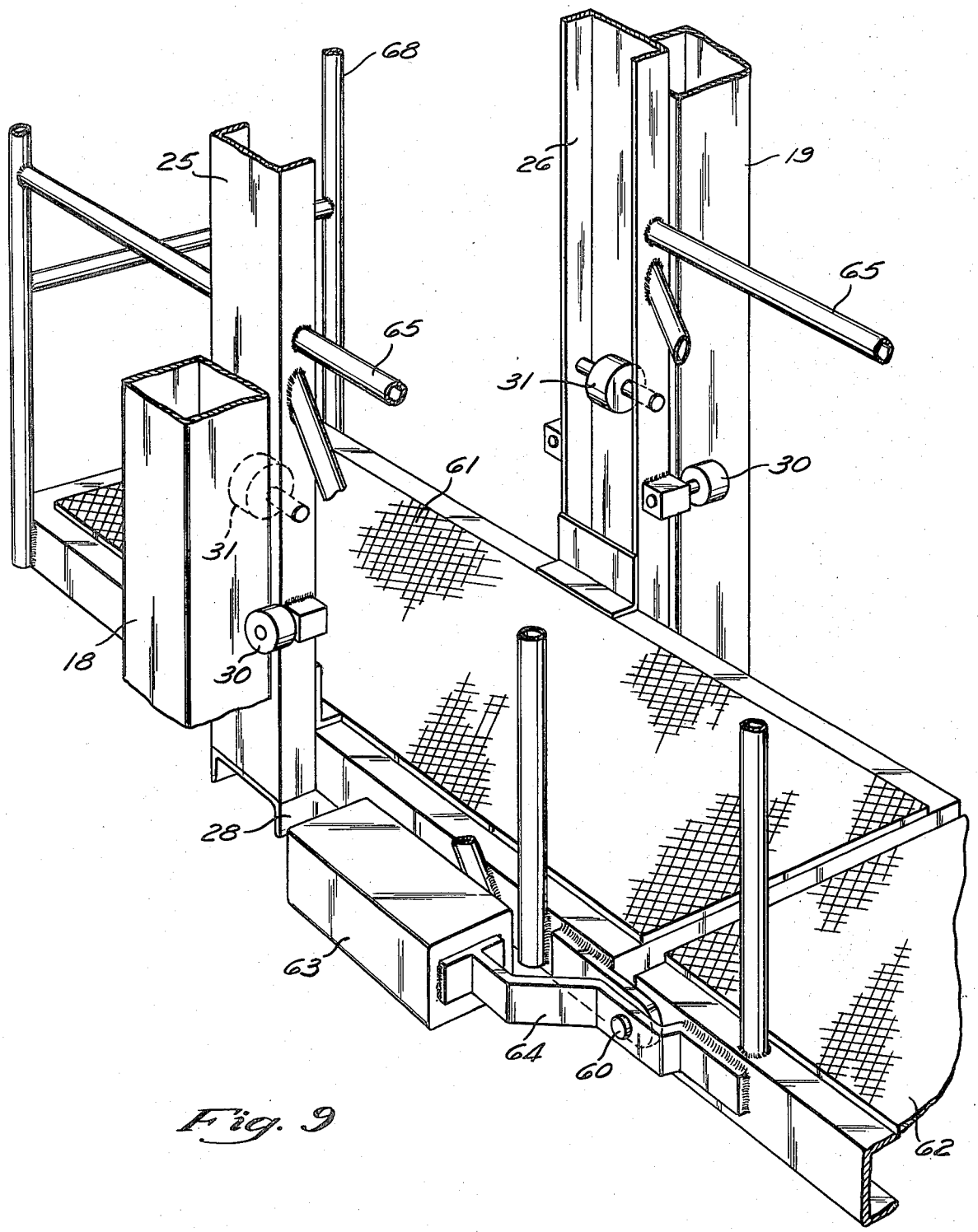
FIG. 9 is a detailed, perspective view of the hinged connection between the carriage and the boarding ramp.

Mounted for vertical movement between the beams 18 and 19 is a boarding platform assembly 22 which includes a ramp 23 and a carriage 24. The carriage 24 is essentially a rectangular box having side beams 25 and 26 connected by an upper beam 27 and a lower beam 28 (FIG. 9). The carriage is mounted for upward and downward vertical movement relative to the track assembly by a series of rollers which include opposed outside rollers 29 and 30, which are rotatably mounted on the beams 25 and 26 and which project therefrom to embrace the columns 18 and 19. The rollers further include a plurality of inside rollers 31 which are rotatably mounted in the beams 25 and 26 and which project through apertures 32 in the beams 25 and 26 to engage the inner faces of the columns 18 and 19.

To move the carriage upwardly and downwardly to a desired level, there is provided a cable winding assembly 33 powered by an electric motor. The winding assembly 33 is suspended from a load cell 34, which in turn is suspended from the beam 20. To minimize the effective load on the motor 33 and the load cell 34, a pair of counterweights 35 and 36 are provided. The counterweights 35 and 36 are respectively encased within the columns 18 and 19 and are suspended by cables 37 and 38, which are trained over pulleys 39 and 40 which are mounted at the upper ends of the columns 18 and 19. The cables are attached to the carriage 24 by eyes 41 and 42 so that a main winding cable 43, and therefore the load cell 34, carries only about 100 pounds of the combined weight of the carriage.

A pair of locking dogs 44 and 45 engage one of a series of projecting pins 46 on the columns 18 and 19 under certain emergency conditions, which will be explained. The load cell 34 is a high-low detector so that the load cell does not respond to loads of about 100 pounds. If the load cell 34 senses weights which are substantially more or substantially less than 100 pounds, solenoids 47 and 48 are de-energized to permit springs 49 and 50 to extend the dogs 44 and 45 to the location illustrated in FIG. 6 so that they are in an interfering position with respect to the pins 46. Low loading conditions would be sensed if the winding cable 43 broke and the dogs 44 and 45 would be immediately extended and the carriage would fall no further than the distance between adjacent pins 46 (typically one foot). High load conditions would be sensed if a person stepped onto or remained on the boarding platform 23 or if one or more of the counterweight cables 37 and 38 broke. When the solenoids are de-energized, limit switches 51 and 52 are operated to immediately shut down the motor 33 and apply a brake to the winding motor. In an at-rest position, the motor is shut down, the brake is applied, and the solenoids 47 and 48 are de-energized to extend the pins 44 and 45. When the motor is energized, and if a person is not on the platform 23, the solenoids 47 and 48 are energized to withdraw the pins 44 and 45 from their position illustrated in FIG. 7 so that the carriage 24 may be moved upwardly or downwardly.

Figure 5:
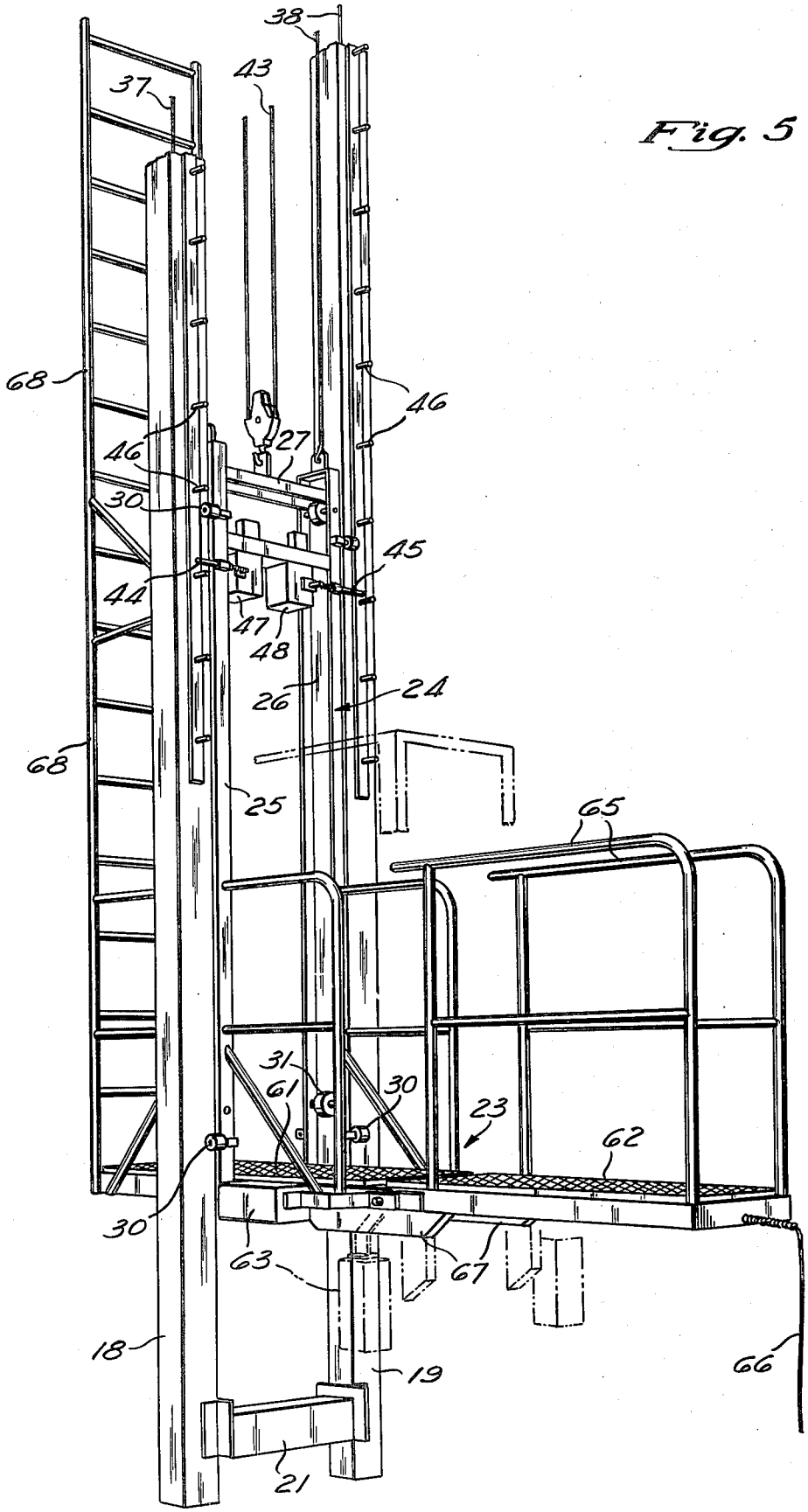
FIG. 5 is a perspective view of the carriage and ramp portions of the boarding platform.

The boarding platform is hinged at about its midpoint by a hinge pin 60 so that the boarding platform 23 includes a portion 61 which is fixed to the carriage 24 and a movable portion 62 which is normally held in a vertical position, as is indicated in phantom outline in FIGS. 2 and 5, by a pair of counterweights 63 which are pivotally associated with the hinge pin 60 by straps 64. The weight of a person is sufficient to lower the portion 62 to the positiion illustrated in solid outline in the drawings so that a vessel may be boarded merely by pushing side handrails 65 and walking onto the portion 62. To lower the portion 62 to a horizontal position when a person is standing on the vessel to debark, a line 66 is provided. The movable portion 62 is retained in a horizontal position by the weight of the person and by support members 67, which are welded to the fixed portion 61.

Extending upwardly from the rear of the fixed portion 61 is a ladder 68 having a vertical extent which is at least as great as the vertical distance between the levels 11–14 so that access may be had to at least one of those levels regardless of the vertical position of the boarding platform.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A boarding platform for transferring personnel between a fixed dock structure and a barge or the like, comprising a stationary frame assembly including vertical track means adapted to be fixed to a dock, boarding platform means having a ramp portion and being mounted on said track means for raising and lowering movement along said track means to attain a number of boarding levels, cable means on said assembly to raise and lower said platform means, locking means between the track means and the platform means, sensing means on said assembly for sensing the weight of the platform means and for sensing the weight of an object on the platform means, said sensing means being connected to said frame assembly and supporting said cable means, means on said assembly responsive to said sensing means to actuate said locking means when a load less than the weight of said platform means is sensed and to actuate said locking means when a load more than the weight of said platform means is sensed.

2. A boarding platform according to claim 1, wherein said sensing means comprises a load cell.

3. A boarding platform according to claim 2, wherein said means to raise and lower said boarding platform means supports about 100 pounds of the weight of said platform means, with the remainder of the weight of said platform means being supported by said counterweight means, and wherein load cell is adapted to sense loads of substantially more than 100 pounds to actuate said locking means and to sense loads of substantially less than 100 pounds to also actuate said locking means.

4. A boarding platform according to claim 1, wherein said boarding platform means further includes a carriage and wherein said ramp portion is hinged to said carriage.

5. A boarding platform according to claim 4, wherein said ramp portion is provided with counterweight means to maintain the ramp portion in a normally raised position.

6. A boarding platform according to claim 4, wherein said carriage is provided with roller means which coact with said vertical track means to guide said carriage along said track means.

7. A boarding platform according to claim 4, wherein the boarding platform means is supported by counterweight means and by said means to raise and lower said platform means.

8. A boarding platform for transporting personnel between a fixed dock structure and a barge or the like, comprising vertical track means comprising a pair of parallel, vertical columns, boarding platform means including a carriage movable along said track means and having rollers coacting with said columns, said boarding platform means further comprising a ramp portion, locking means comprising a series of pins projecting from said columns which are engageable by solenoid-operated locking dogs on said platform means, a cable for raising and lowering said platform means and for carrying a portion of the weight of said platform means, said cable being connected to a load cell which in turn is connected to said platform means, counterweights supporting the remainder of the weight of said platform means, said locking means being responsive to signals generated by said load cell to operate said locking dogs, said load cell being responsive to increases and decreases in the weight of said platform means to generate said signals (a) when a person stands on the ramp portion, (b) if said cable breaks, or (c) if one or more of said counterweights releases.

9. A boarding platform according to claim 8, wherein said ramp portion is hinged to said carriage.

10. A boarding platform according to claim 9, wherein said ramp portion is provided with counterweight means to maintain the ramp portion in a normally raised position.

11. A boarding platform and landing dock arrangement for transferring personnel between the landing dock and a barge or the like, comprising a landing dock having a number of levels and having an open portion to the waterfront, a stationary frame assembly including vertical track means attached to the dock structure at the open portion thereof, boarding platform means having a ramp portion and being mounted on said track means for raising and lowering movements along said track means to attain a number of boarding levels, cable means for raising and lowering said platform means, a vertical ladder extending from said platform means and having a length greater than the vertical distance between dock levels, locking means between the track means and the platform means, sensing means for sensing the weight of the platform means and for sensing the weight of an object on said platform means, said sensing means being connected to said frame assembly and supporting said cable means, means responsive to said sensing means to actuate said locking means when a load less than the weight of said platform is sensed and to actuate said locking means when a load more than the weight of said platform is sensed.

12. A boarding platform according to claim 11, wherein said sensing means comprises a load cell.

13. A boarding platform according to claim 12, wherein said cable means to raise and lower said boarding platform means supports about 100 pounds of the weight of said platform means, with the remainder of the weight of said platform means being supported by counterweight means, and wherein said load cell is adapted to sense loads of substantially more than 100 pounds to actuate said locking means and to sense loads of substantially less than 100 pounds to also actuate said locking means.

14. A boarding platform according to claim 11, wherein said boarding platform means further comprises a carriage and wherein said ramp portion is hinged to said carriage.

15. A boarding platform according to claim 14, wherein said ramp portion is provided with counterweight means to maintain the ramp portion in a normally raised position.

16. A boarding platform according to claim 14, wherein said carriage is provided with roller means which coact with said vertical track means to guide said carriage along said track means.

17. A boarding platform according to claim 14, wherein the boarding platform means is supported by counterweight means and by said cable means to raise and lower said platform means.

* * * * *